United States Patent [19]

Dufrene

[11] Patent Number: 4,998,898

[45] Date of Patent: Mar. 12, 1991

[54] ULTRALIGHT/COMPACT AIRBOAT APPARATUS

[76] Inventor: Randy Dufrene, P.O. Box 991, Luling, La. 70070

[21] Appl. No.: 332,958

[22] Filed: Mar. 31, 1989

[51] Int. Cl.[5] ..... B63H 7/00

[52] U.S. Cl. ..... 440/37; 114/56

[58] Field of Search ..... 114/56, 63, 270, 271, 114/285; 440/37

[56] References Cited

U.S. PATENT DOCUMENTS

| | | | |
|---|---|---|---|
| 2,741,207 | 4/1956 | Leone | 114/271 |
| 3,500,784 | 3/1970 | Reynolds | 114/285 |
| 4,002,131 | 1/1977 | Mangrum | 114/63 |

FOREIGN PATENT DOCUMENTS

| | | | |
|---|---|---|---|
| 279353 | 8/1970 | U.S.S.R. | 440/37 |

*Primary Examiner*—Joseph F. Peters, Jr.
*Assistant Examiner*—Edwin L. Swinehart
*Attorney, Agent, or Firm*—Pravel, Gambrell, Hewitt, Kimball & Krieger

[57] ABSTRACT

An ultralight/compact airboat construction weighing less than five hundred (500) pounds yet stable at high speeds of, for example, in excess of forty (40) mph is provided. The hull provides a unique configuration having a parabolic flat portion positioned upon the bottom of the hull and communicating with the transom wherein the widest part of the parabolic flat-shaped portion communicates with the transom. The hull gradually decreases in width and depth beginning at the midpoint of the vessel and proceeding forwardly toward a blunt nose.

7 Claims, 2 Drawing Sheets

ULTRALIGHT/COMPACT AIRBOAT APPARATUS

BACKGROUND OF THE INVENTION

1. Field of the Invention

The present invention relates to airboats, and more particularly to an improved airboat construction having a compact and lightweight configuration which allows the apparatus to function at high speeds, and yet remain stable and wherein the entire apparatus weighs less than 500 pounds so that a few individuals can lift it onto a trailer.

2. General Background

Air boats have been made for a number of years, and used both commercially and as pleasure craft in marsh and swamp areas, such as in the Florida Everglades and in the Louisiana marsh and swampland. Air boats typically include a hull with a seat that sits high above the hull and with a motor bracket support which carries an aircraft-type engine. Steering is performed by means of rudders which are mounted aft the aircraft engine and connected to a stick operable by the boat pilot. Typically, the engine faces rearwardly so that the propeller functions as a pusher.

Most conventional airboats are very large and substantial craft weighing thousands of pounds. These craft are necessarily heavy because of the use of aircraft engines and because of the stability which must be provided to prevent overturning during use.

The conventional, commercially available airboat normally utilizes an aircraft engine costing many thousands of dollars, in combination with a substantial hull and frame configuration. The price of an airboat is normally substantial, usually beyond the means of the average consumer.

Typically, very large aircraft engines create a tremendous amount of noise which renders them impractical for numerous sporting uses. For example, waterfowl hunters are prohibited in many situations from using airboats because of the noise problem. The game is so frightened by the noise generated by an aircraft engine that hunting can be poor or non-existent if airboats are used. Further, very large and heavy airboats can create an environmental impact because of destruction that they can impart to fragile wetlands because of their weight and size.

Thus, there is a need for a lightweight, compact yet stable airboat apparatus which can be made with a very small aircraft-type engine, minimizing the level of noise and thus impact upon the environment. Further, there is a need for a compact, lightweight yet stable airboat which can used by individuals and hunters for sporting purposes yet be stable enough to function at high speeds of forty miles per hour, for example, during turns, and when climbing over intermittently spaced land masses, such as levees, beaches and the like.

GENERAL DISCUSSION OF THE PRESENT INVENTION

The present invention solves these prior art problems and shortcomings by providing an ultralight, compact airboat apparatus. The apparatus includes a hull having a wide stern defining substantially the beam of the hull, the approximate rear one-half of the hull being of generally the uniform beam width, the hull having a blunt nose portion defining a narrowest portion of the hull. The hull bottom includes a flat portion which is generally parabolic-shaped, wide at the stern and narrower toward the middle of the hull. The hull has a chine area with a small radius of curvature that defines in vertical section, an interface between the hull bottom and the hull sidewalls which interface gradually approaching the blunt nose in the forward half of the hull, thus gradually decreasing the depth of the sides. A motor support is rigidly mounted within the confines of the hull transom and sidewalls and extends upwardly. A motor drive carrying an enlarged pusher propeller is mounted upon the motor drive. A cage protectively surrounds the motor and the propeller. An operator's seat is positioned above the hull and substantially on equal elevation with the motor drive. One or more rudders are positioned aft of the motor drive and propeller for steering the hull. The motor drive rudders, seat, and cage extend well above the hull, and the apparatus has a total weight of less than five hundred (500) pounds.

In the preferred embodiment, the blunt nose is substantially narrower than the overall beam by at least a factor of three to one.

In the preferred embodiment, the hull has a depth at the blunt nose of less than one-third the depth at the stern transom.

In the preferred embodiment, the small radius of curvature is less than six (6) inches.

In the preferred embodiment, the small radius of curvature is between three (3) inches and six (6) inches.

In the preferred embodiment, the forward half of the hull has a configuration in plan with a variable beam, and sides that generally track a parabolic shape.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 1:
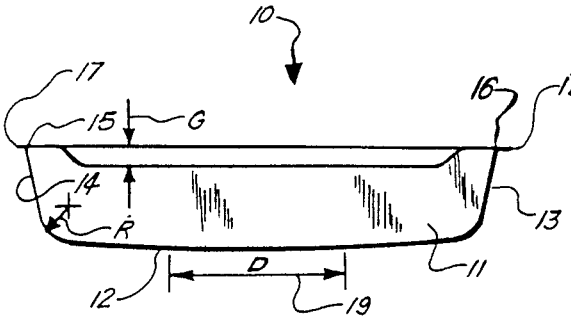
FIG. 1 is a rear view of the preferred embodiment of the apparatus of the present invention illustrating the hull portion thereof.

FIGS. 1–4 illustrate the preferred embodiment of the apparatus of the present invention, and more particularly the hull 11 portion thereof. Apparatus 10 includes a hull 11 having a bottom 12 which includes both flat 24 and curved portions, as will be described more fully hereinafter. Hull 11 includes a pair of sidewalls 13, 14 connected to the bottom 12 at curved interfaces 36, 37.

Curvatures 36, 37 are preferably of a radius between three (3) and six (6) inches.

An upwardly and outwardly extending peripheral lip 17 provides a spray chine for hull 11. Gunnels 15, 16 define the top of each sidewall 13, 14.

Figure 2:
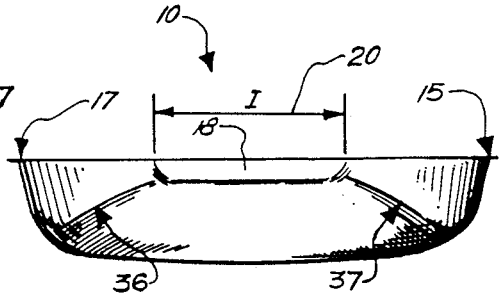
FIG. 2 is a front view of the preferred embodiment of the apparatus of the present invention illustrating the hull portion thereof.

In FIG. 2, a front view illustrates a curved nose 18 which has a width 20 (see arrow of FIG. 2) which is much smaller than the width 23 (see arrow of FIG. 3) at the transom or stern area 19. The transom or stern area 19 is preferably at least three times the width 20 of nose 18. The narrow nose 18 helps negotiate through grasses, reeds and other upwardly extending vegetation.

Figure 4:
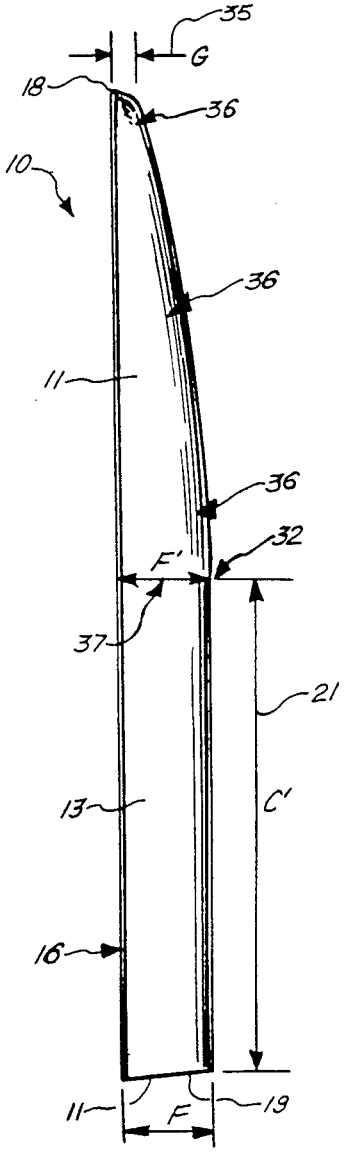
FIG. 4 is a side view of the preferred embodiment of the apparatus of the present invention.

The pair of forwardly extending curved interface lines 36, 37 extend from the transom and forwardly up to the blunt nose 18. Notice from an inspection of FIG. 2, that the interface lines 36, 37 are generally of constant position with respect to the gunnels 15, 16 until the midpoint 32 of the hull is reached, the sidewalls 13, 14 are relatively constant depth F, F', as indicated in FIG. 4. The dimension F would be slightly smaller than the dimension F' so that the hull would preferably be slightly deeper at the midpoint 32.

As exemplary dimensions, the hull length 22 (arrow in FIG. 3) would be approximately one hundred forty (140) inches or about twelve (12) feet. The hull depth F at the transom would be approximately 15 inches and the depth at the hull midpoint 32 would be approximately 16 inches. The midpoint of the vessel would thus be the dimension 21 (arrow of FIG. 4) which would be approximately seventy (70) inches from the transom 19. The nose 18 would have a dimension of, for example, twenty (20) inches as compared with the width 23 of the transom which is approximately sixty three (63) inches. The blunt nose 18 has a very small depth of approximately 4 inches as compared with the dimensions given above for the rest of the hull.

Figure 3:
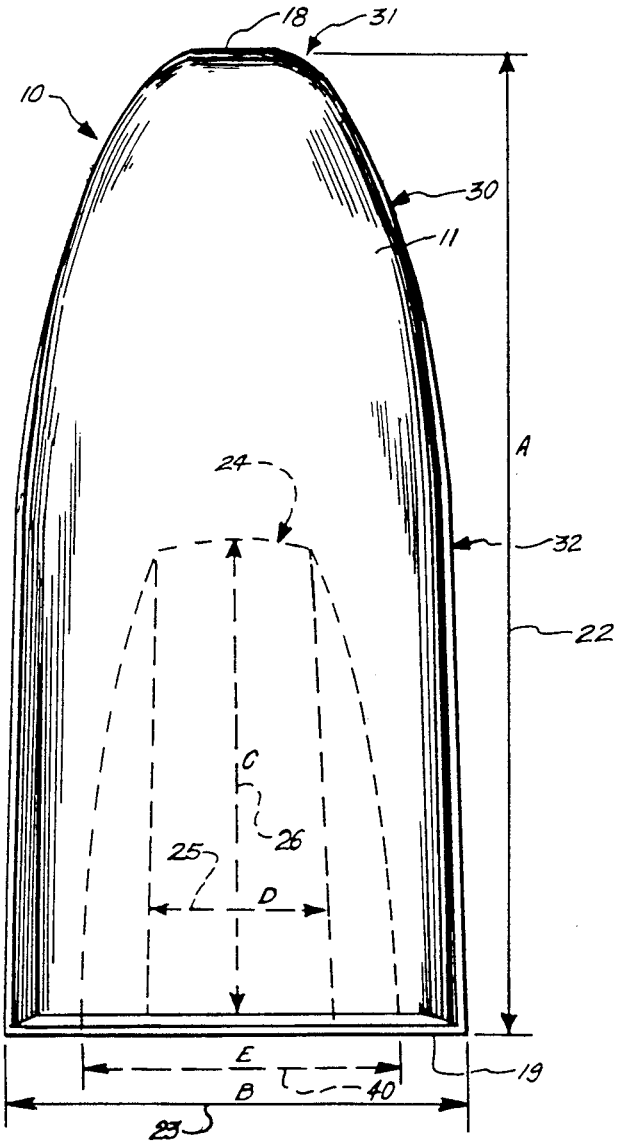
FIG. 3 is a top view of the preferred embodiment of the apparatus of the present invention.

The parabolic flat bottom portion 24 would be relatively narrow, on the order of twenty (20) inches (arrow 25, FIG. 3), at the midpoint 32 of the vessel hull and larger, or on the order of about 40 inches, as indicated by the dimension arrow line 40 in FIG. 3.

Figure 5:
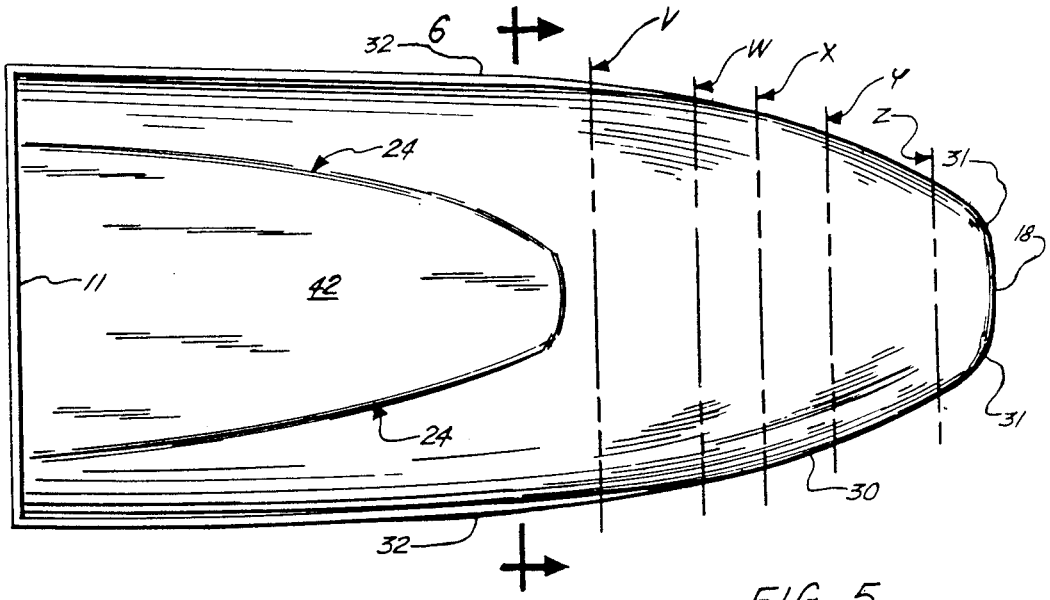
FIG. 5 is a bottom view of the preferred embodiment of the apparatus of the present invention.

In the section view of FIG. 5 which is taken at the midpoint of the vessel 10, the sides 13, 14 are shown as well as the depth Fl indicated by the numeral 37 which would be approximately equal to but slightly larger than the depth of the hull at transom 19. The flat bottom portion 42 is bounded by a peripheral parabolic line 24, as seen in FIGS. 3 and 5. Thus, when the boat is running, only a very small portion of the surface area of the bottom of the boat touches the water surface, being primarily that flat portion 42 bounded by the peripheral line 24 of parabolic shape. The remainder of hull 11 bottom 12 is curved.

Figure 6:
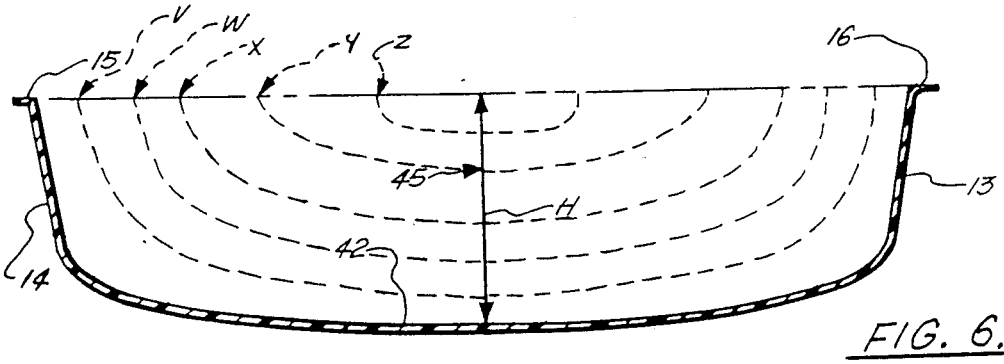
FIG. 6 is a sectional view taken along lines 6-6 of FIG. 5.

The forward half of hull 11 has a generally rounded configuration defined by vertical sections V, W, X, Y, Z that are half ellipses (FIG. 6) gradually decreasing in size. The larger half ellipse section A positioned, as shown in FIG. 5, adjacent but immediately forward the vessel midpoint which is the position of section lines 6—6.

Figure 7:
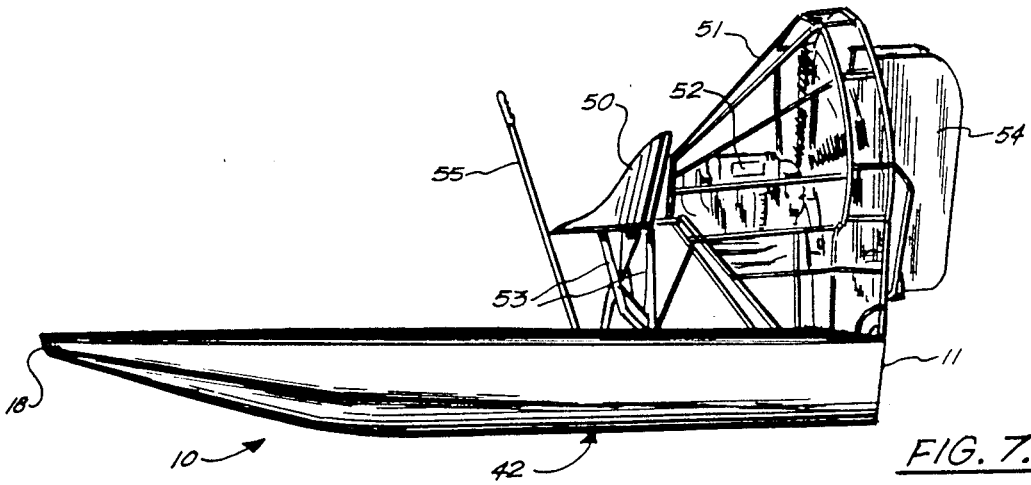
FIG. 7 is a side elevational view of the preferred embodiment of the apparatus of the present invention illustrating the entire apparatus including the motor drive, seat, rudder, hull, and steering portions thereof.

In FIG. 7, the overall elevational view of the apparatus 10 is illustrated showing the blunt nose 18 and flat transom 19 portions thereof, as well as the bottom 42, the support frame 53, supporting the seat 50 and drive motor 52. Motor 52 is provided with a propeller 56 which is preferably a pusher prop arrangement so that the rudders 54 positioned aft can be used to steer the vessel using control stick 55.

The pilot's seat 50 is positioned upon the frame 53 so that the engine, rudders, and seat are all at an approximate equal horizontal elevational with respect to one another.

In view of the numerous modifications which could be made to the preferred embodiments disclosed herein without departing from the scope or spirit of the present invention, the details herein are to be interpreted as illustrative and not in a limiting sense.

What is claimed as invention is:

1. An ultralight compact airboat apparatus comprising:

(a) a hull having a wide transom defining substantially the beam of the hull and the approximate rear one-half of the hull being of generally uniform beam width, the hull having a blunt nose portion defining the narrowest portion of the hull and outwardly included sidewalls that are flat at the rear half;

(b) the hull bottom having a generally flat parabolic-shaped portion that is wide at the stern and narrower toward the middle of the hull;

(c) at least the rear half of the hull having transition portion with a continuous curvature of a small radius of curvature that defines an interface between the hull bottom and sidewall, and the sidewall having a curvature that gradually increases toward the blunt nose in the forward half of the hull;

(d) a motor support rigidly mounted inboard of the hull transom and sidewalls, and extending upwardly;

(e) a motor drive carrying an enlarged propeller;

(f) a cage protectively surrounding the motor and propeller;

(g) an operator's seat positioned above the hull on substantially equal elevation with the motor drive;

(h) one or more rudders positioned aft of the motor drive and propeller for steering the hull; and (i) the motor drive rudders, seat, and cage extending well above the hull.

2. The apparatus of claim 1, wherein the blunt nose is substantially narrower than the beam.

3. The apparatus of claim 1, wherein he hull has a depth at the blunt nose of less than one-third of the depth of the transom.

4. The apparatus of claim 1, wherein the small radius of curvature is less than 6 inches.

5. The apparatus of claim 1, wherein the small radius of curvature is between 3 inches and 6 inches.

6. The apparatus of claim 1, wherein the entire apparatus has a weight of less than five hundred (500) pounds.

7. The apparatus of claim 1, wherein the forward half of the hull has a beam which varies such that said sidewalls generally track a parabolic shape.

* * * * *